US009689344B1

(12) United States Patent
Gedeon

(10) Patent No.: US 9,689,344 B1
(45) Date of Patent: Jun. 27, 2017

(54) DOUBLE-ACTING MODULAR FREE-PISTON STIRLING MACHINES WITHOUT BUFFER SPACES

(71) Applicant: David Ray Gedeon, Athens, OH (US)

(72) Inventor: David Ray Gedeon, Athens, OH (US)

( * ) Notice: Subject to any disclaimer, the term of this patent is extended or adjusted under 35 U.S.C. 154(b) by 664 days.

(21) Appl. No.: 14/146,146

(22) Filed: Jan. 2, 2014

Related U.S. Application Data

(60) Provisional application No. 61/750,442, filed on Jan. 9, 2013.

(51) Int. Cl.
*F02G 1/04* (2006.01)
*F02G 1/044* (2006.01)
*F02G 1/057* (2006.01)

(52) U.S. Cl.
CPC ..... *F02G 1/044* (2013.01); *F02G 1/057* (2013.01)

(58) Field of Classification Search
CPC ..... F02G 1/044; F02G 1/057; F02G 1/043; F02G 1/053; F02G 1/055; F02G 2243/30; F02G 2243/40; H02K 33/00–33/18
USPC ..... 60/525, 620, 523, 517; 310/13, 14, 15, 310/17, 20, 23, 25, 27, 28–35
See application file for complete search history.

(56) References Cited

U.S. PATENT DOCUMENTS

| | | | | |
|---|---|---|---|---|
| 4,365,474 | A | 12/1982 | Carlqvist | |
| 4,526,008 | A | 7/1985 | Taylor, Sr. | |
| 4,602,174 | A * | 7/1986 | Redlich | H02K 35/02 290/1 R |
| 6,483,207 | B1 | 11/2002 | Redlich | |
| 7,134,279 | B2 | 11/2006 | White et al. | |
| 7,171,811 | B1 | 2/2007 | Berchowitz et al. | |
| 8,820,068 | B2 * | 9/2014 | Dadd | F02G 1/0435 60/517 |

OTHER PUBLICATIONS

G. Walker and J.R. Senft, "Free Piston Stirling Engines", Springer-Verlag (1985), pp. 38-41.

* cited by examiner

*Primary Examiner* — Phutthiwat Wongwian
*Assistant Examiner* — Kelsey Stanek
(74) *Attorney, Agent, or Firm* — James R. Eley; Ronald J. Koch; Eley Law Firm Co. LPA

(57) ABSTRACT

Multiple free-piston stirling-cycle machine modules are connected together in double-acting configurations that may be used as engines or heat pumps and scaled to any power level by varying the number of modules. Reciprocating piston assemblies oriented in balanced pairs reduce vibration forces. There are no buffer spaces. Linear motors or generators are packaged inside piston cavities entirely within the module working spaces. The external heat-accepting and heat-rejecting surfaces in one embodiment are directed along inward-facing and outward facing cylinders, and in another embodiment along parallel planes, simplifying thermal connections to the external heat source and sink.

13 Claims, 11 Drawing Sheets

DOUBLE-ACTING MODULAR FREE-PISTON STIRLING MACHINES WITHOUT BUFFER SPACES

CROSS REFERENCE TO RELATED APPLICATIONS

This application claims the benefit of provisional patent application Ser. No. 61/750,442, filed 2013 Jan. 9 by the present inventor.

BACKGROUND

The following prior art appears relevant:

U.S. patents

| Pat. No. | Kind Code | Issue Date | Patentee |
|---|---|---|---|
| 4,365,474 | | 1982 Dec. 28 | Stig G. Carlqvist |
| 4,526,008 | | 1985 Jul. 2 | Carol O. Taylor, Sr |
| 6,483,207 | B1 | 2002 Nov. 19 | Robert W. Redlich |
| 7,134,279 | B2 | 2006 Nov. 14 | Maurice A. White et al. |
| 7,171,811 | B1 | 2007 Feb. 6 | David M. Berchowitz et al. |

NONPATENT LITERATURE DOCUMENTS

G. Walker and J. R. Senft, "Free Piston Stirling Engines", Springer-Verlag (1985)

TECHNICAL FIELD

This invention relates generally to stirling-cycle machines and more particularly to vibration-balanced free-piston double-acting machines.

DISCUSSION OF PRIOR ART

Stirling-cycle machines, or stirling machines for short, are presently used as heat engines and heat pumps. A heat engine accepts heat from a high temperature source and rejects heat to a lower temperature sink in order to produce mechanical power to drive a load. A heat pump accepts mechanical power from a prime mover in order to pump heat from a low temperature source to a higher temperature sink.

All stirling machines function by alternately expanding and compressing a working fluid, usually a gas like helium, while simultaneously displacing the working fluid through heat exchangers so that on the whole its temperature is changed prior to expansion and changed again prior to compression. If the temperature is increased prior to expansion and decreased prior to compression the pressure during the expansion process is generally higher than during the compression process and the working fluid delivers mechanical power to the moving boundaries of the working space. In this case the machine functions as a heat engine. If the temperature is decreased prior to expansion and increased prior to compression the pressure during the expansion process is generally lower than during the compression process and the moving boundaries of the working space deliver power to the working fluid. In this case the machine functions as a heat pump.

All stirling machines contain a thermodynamic working-fluid circuit typically including five fundamental elements connected in series, usually hermetically sealed from the outside environment:

(a) a compression space,
(b) a heat-rejecting heat exchanger where heat flows from the working fluid to an external heat sink,
(c) a regenerator containing a porous matrix with excellent heat transfer and minimal flow resistance that changes the temperature of the fluid passing through it,
(d) a heat-accepting heat exchanger where heat flows from an external heat source to the working fluid, and
(e) an expansion space.

One common form of a stirling machine is the beta configuration characterized by reciprocating displacer and piston bodies in a common cylindrical housing. The role of the displacer body is primarily to force the working fluid back and forth through heat exchangers (b, c, d above) in order to produce the temperature changes prior to expansion and compression. The role of the piston body is primarily to expand or compress the working fluid as a whole in order to remove or add mechanical power from or to the working fluid.

A variation of the beta configuration is the gamma configuration where the piston and displacer bodies are located in separate cylinders.

Another form of a stirling machine, and the one of interest here, is the double acting configuration, also referred to as the Rinia or Siemens configuration, characterized by multiple piston bodies in multiple cylindrical housings with an equal number of thermodynamic working fluid circuits located between the piston bodies. Each piston body provides a dual functionality, hence the term double acting. One face of the piston body provides primarily the compression function to the fluid circuit on one side, the other face provides primarily the expansion function to the fluid circuit on the other side. Both piston faces also provide the displacement function to the two fluid circuits. This is typically accomplished by phasing adjacent piston bodies by some regular increment, usually 90 degrees from one to the other so that the most common double acting configuration consists of four pistons and four inter-connected thermodynamic fluid circuits.

The terminology alpha stirling machine is sometimes used for the double-acting configuration but not here because that terminology also applies to stirling machines with two independent piston bodies positioned at the ends of a single thermodynamic fluid circuit, which is fundamentally unlike the invention described here.

Prior art shows:

(a) Double-acting stirling machines where the piston bodies comprise closed hollow shells, each connected to a load or motoring device in a separate buffer space, with a mechanical linkage passing between the piston bodies and load or motoring devices through sealing elements in the piston housing that prevent leakage of the working fluid. (U.S. Pat. No. 4,365,474 to Stig G. Carlqvist, 1982 Dec. 28, FIG. 1; book of G. Walker and J. R. Senft, 1985, "Free Piston Stirling Engines", U.S. Pat. No. 7,134,279 to Maurice A. White et al., 2006 Nov. 14; U.S. Pat. No. 7,171,811 to David M. Berchowitz et al., 2007 Feb. 6, FIG. 2)
(b) A gamma-type stirling cooler where the regenerator is located inside a moving displacer assembly within a separate cold-head and the expansion space also provides the function of the heat-accepting heat exchanger via direct heat transfer to the walls of the expansion space (U.S. Pat. No. 4,526,008 to Carol O. Taylor, 1985 Jul. 2, FIG. 3).

(c) Heat-accepting and rejecting heat exchangers surrounding and symmetrical with the cylindrical housings in which the pistons or displacer bodies reciprocates.

(d) Scaling to high power levels by increasing the machine dimensions so as to produce a higher power per piston.

(e) Moving-magnet type linear motors or generators located outside the stirling-cycle piston body in a separate buffer space.

(f) Magnetic free-piston centering of a moving magnet motor or generator by means of saturating the magnetic flux path (U.S. Pat. No. 6,483,207 to Robert W. Redlich, 2002 Nov. 19).

(g) More than one close-fit sealing element required within or through the piston housing, with concentricity constraints.

SUMMARY OF THE INVENTION

The present invention comprises a class of free-piston stirling-cycle machines employing a plurality of identical modular elements interconnected in double-acting configurations for which two arrangements are discussed, a radial arrangement and a co-axial cylindrical arrangement. Both arrangements can be dynamically balanced for minimal vibration and multiple instances of these arrangements may be combined together to achieve higher power levels. The stirling-cycle components within the modular elements are packaged in a compact design with fewer distinct parts than prior art.

These stirling-cycle machines can be used as heat engines to convert thermal energy into electrical power or as heat pumps to convert electrical power to heat flows for cooling or heating purposes.

ADVANTAGES

Compared to the above list of prior art this invention discloses:

(a) Double-acting stirling-cycle machines where the load or motoring device is located substantially within a cavity of the piston body, rather than in a separate buffer space.

(b) A double-acting stirling-cycle machine where the regenerator is located inside a moving piston assembly and the expansion space also provides the function of the heat-accepting heat exchanger via direct heat transfer to the walls of the expansion space, eliminating the need for those components outside the surrounding cylindrical housing.

(c) Heat-accepting and rejecting heat exchangers packaged to lie on inward-facing and outward facing cylindrical surfaces (radial arrangement) or opposite-facing parallel planes (co-axial cylindrical arrangement), simplifying thermal connections to the external heat source and sink.

(d) Scaling to high power levels by combining and stacking together any number of relatively small, low power modules, reducing heat-flux loadings ($W/cm^2$) on the external heat-accepting and rejecting surfaces because of the high surface to volume ratios associated with small module sizes. For similar reasons low power modules also permit simpler internal working fluid heat exchangers compared to larger machines and avoid the problem of poor internal fluid flow distribution associated with large size stirling machines.

(e) A compact moving magnet type linear motor or generator where the magnets, inner ferromagnetic path and electrical coil lie substantially inside a cavity of the piston body, within the working space, reducing the total wire length needed to achieve a given number of coil windings, and eliminating the need for a separate buffer space. The outer cylinder in which the piston body reciprocates also serves as the outer ferromagnetic return path, simplifying prior art configurations.

(f) Magnetic centering achieved by adjusting the magnetic reluctance of the ferromagnetic flux path, resulting in a nearly linear restoring force.

(g) Only one close-fit sealing element within the piston housing.

DRAWINGS—FIGURES

Figure 7:
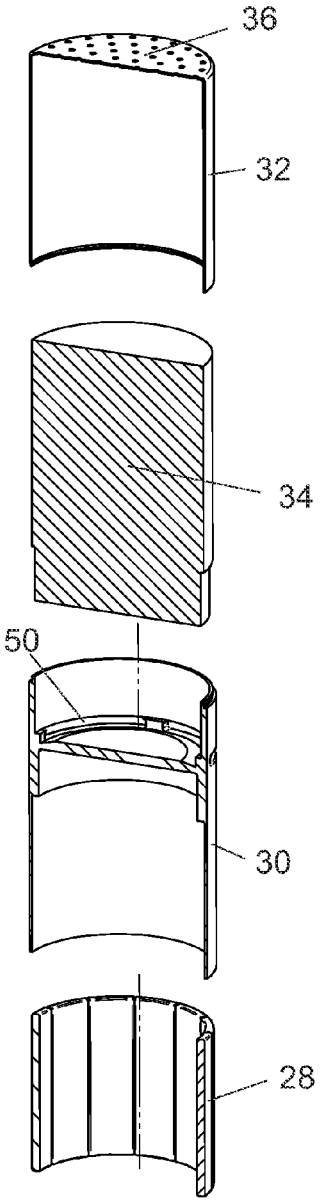

FIG. 7. Shows an exploded cross sectional view of a reciprocating piston assembly.

Figure 8:
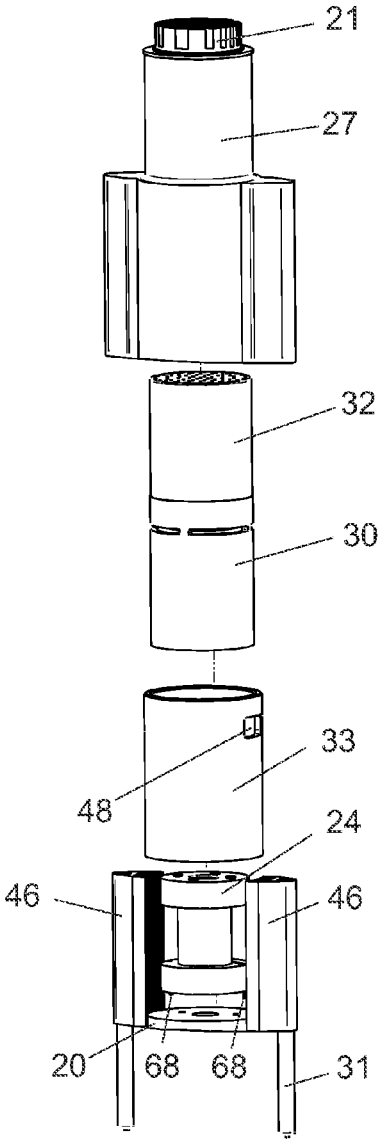

FIG. 8. Shows an exploded cross sectional view of a complete module assembly.

Figure 9:
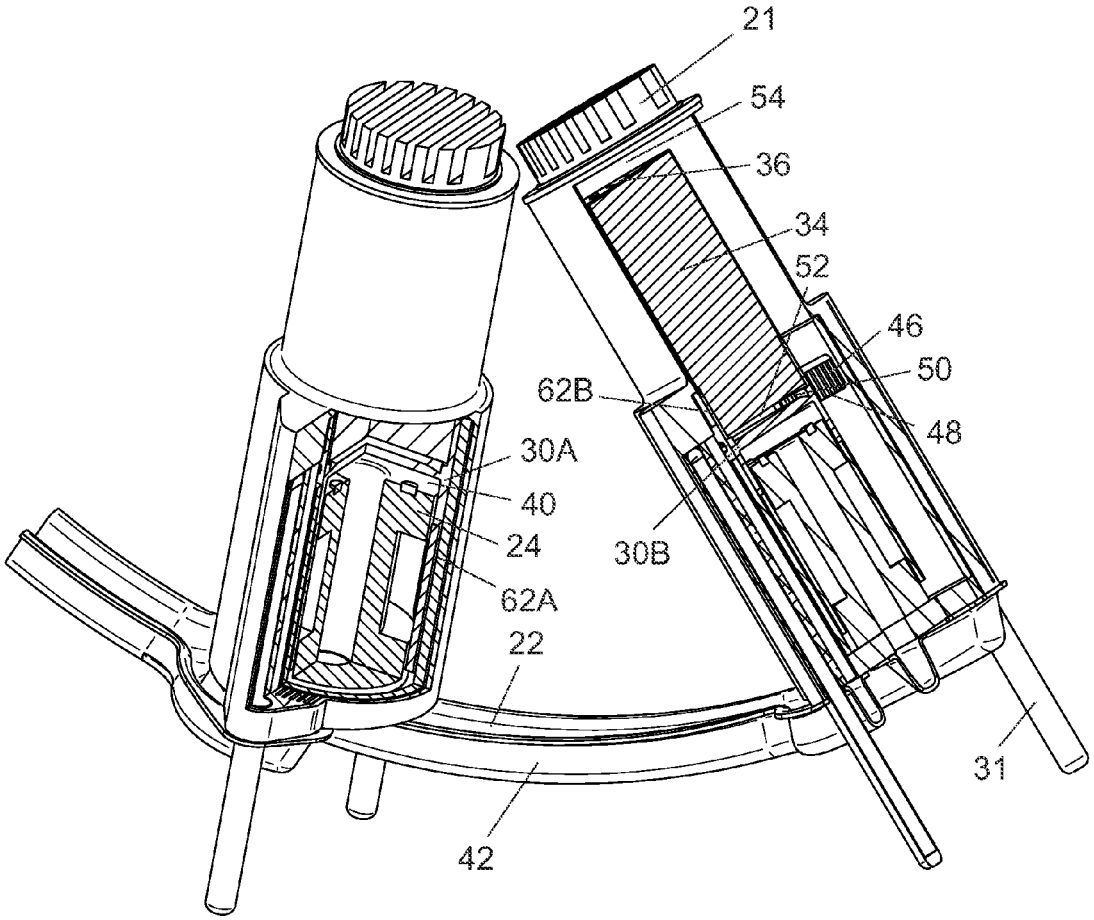

FIG. 9 shows a cross sectional view of an elemental working fluid circuit.

Figure 10:
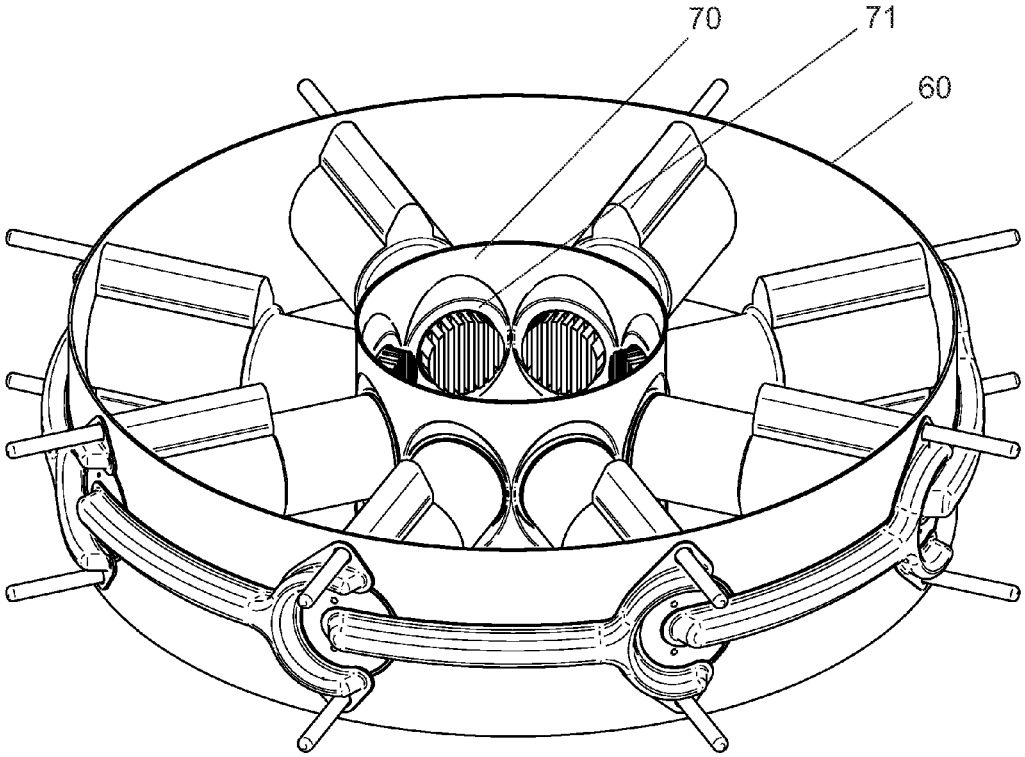

FIG. 10. shows eight modules in a radial arrangement.

Figure 11:
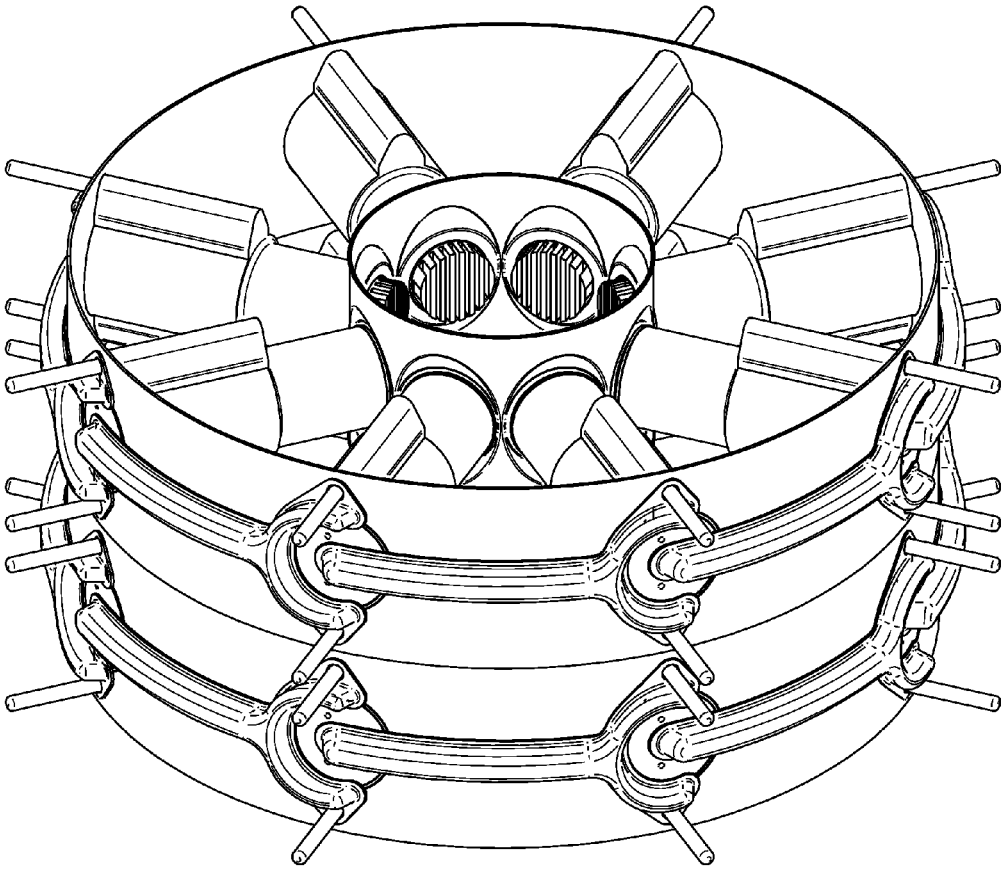

FIG. 11. shows two radial-arrangement embodiments stacked together.

Figure 12:
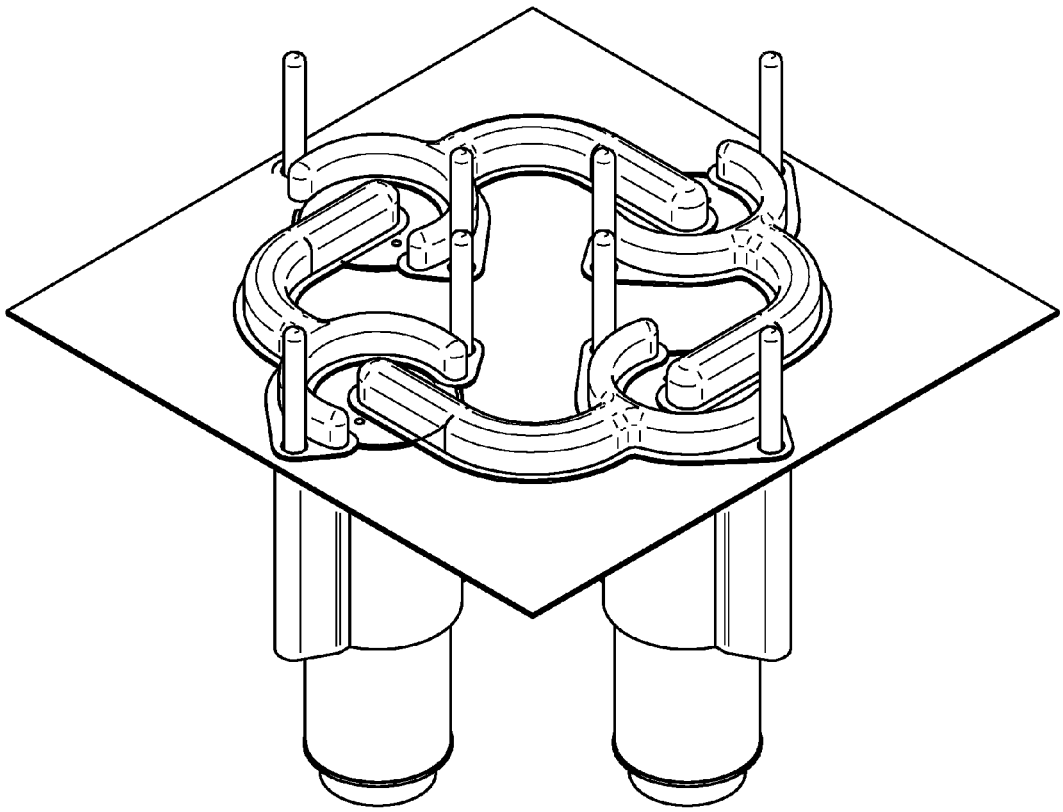

FIG. 12 shows four modules in a co-axial cylindrical arrangement.

Figure 13:
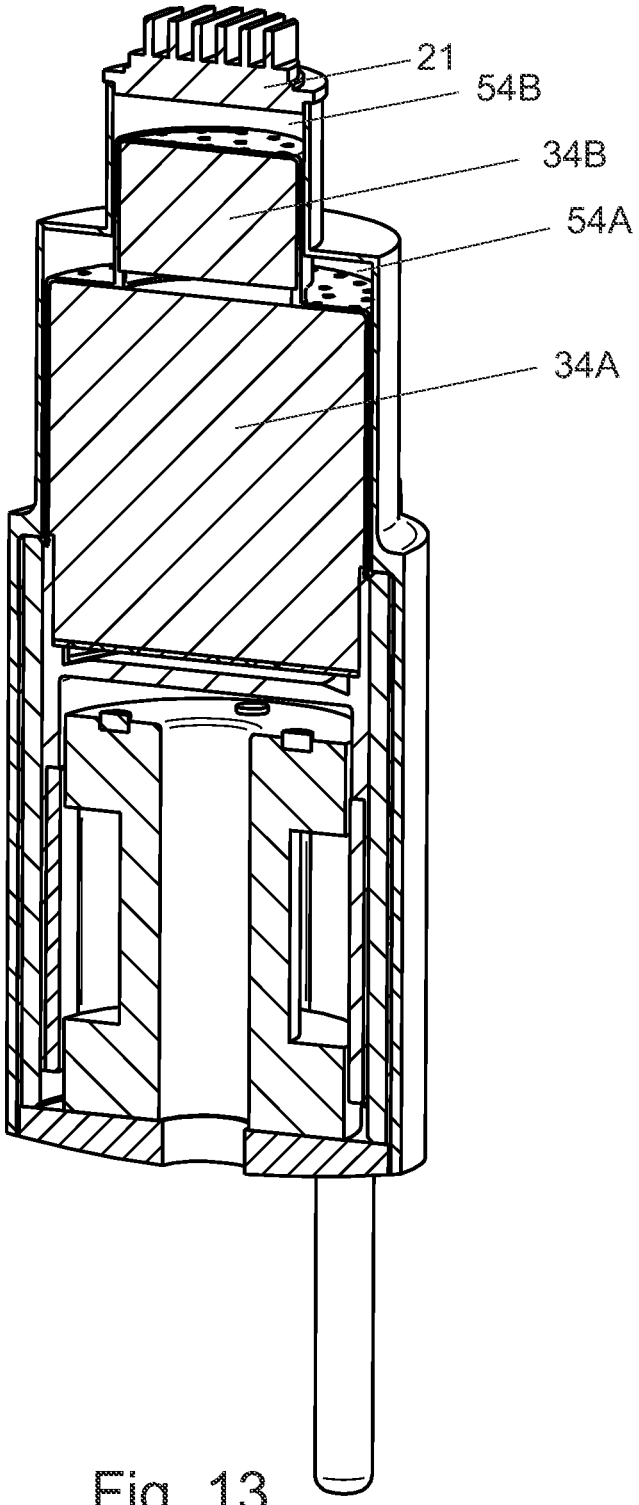

FIG. 13 shows a cross sectional view of a stepped-piston two-stage cooler module.

Figure 14:
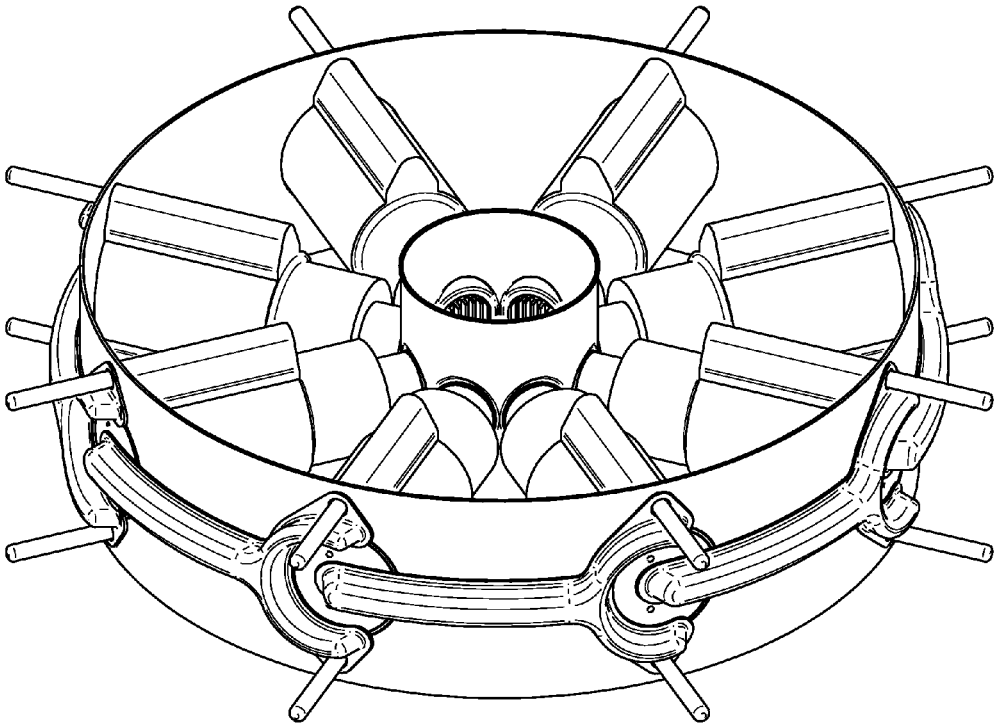

FIG. 14 shows eight two-stage cooler modules in a radial arrangement.

DRAWINGS—REFERENCE NUMERALS

20—bobbin plate
21—heat-acceptor plate
22—inter-module duct
23—load or motoring device
24—inner bobbin
25—elastic bumper
26—electrical coil winding space
27—pressure wall
28—permanent magnet ring
29—weld
30—piston body
31—heat-rejection path of high thermal conductivity
32—piston shell
33—outer cylinder
34—regenerator matrix
36—turbulator
40—compression space
42—duct manifold
46—heat-rejecting heat exchanger

Figure 4:
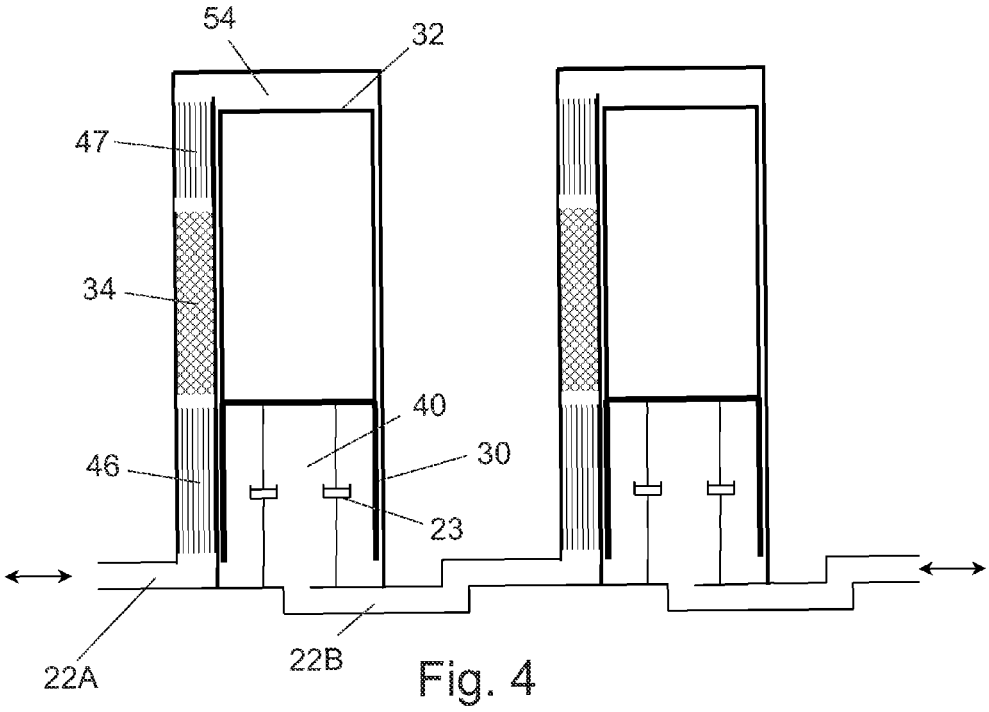
FIG. 4 shows a schematic of one inter-module connection scheme of the present invention.

47—heat-accepting heat exchanger
48—cylinder ports
50—piston ports
52—plenum
54—expansion space
60—duct plate
62—clearance seal
68—wire feed through
70—inner vacuum wall
71—flattened strain-relief region Operation—External Heat Exchanger Embodiment—FIG. 4

The invention is generally described below in terms of operation as a stirling heat pump or cooler. The description is substantially the same for an engine, including the direction of heat flow.

Figure 1:
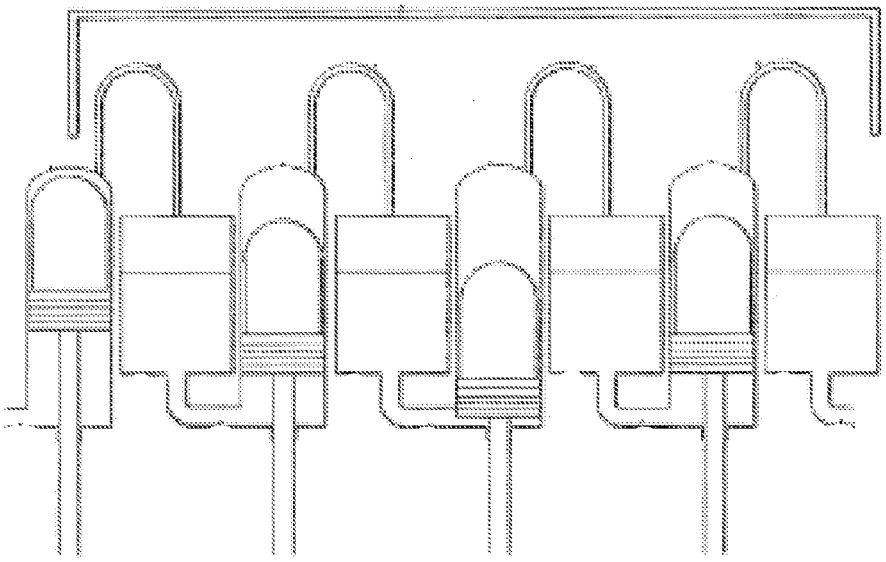
Fig. 1 Prior Art
FIG. 1 shows a prior art schematic of a double-acting stirling machine.
Figure 2:
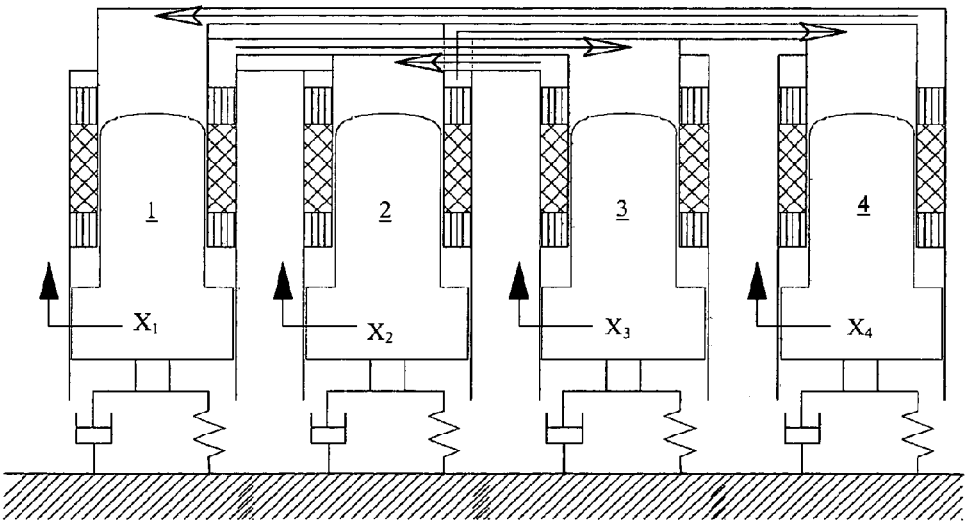
Fig. 2 Prior Art
FIG. 2 shows a prior art schematic of a free-piston double-acting stirling machine.

The invention comprises a plurality of inter-connected elemental modules. FIG. 4 shows schematically the components inside a module, illustrating the working fluid flow path of one embodiment, and how two successive modules are interconnected. Starting at the left, fluid flows through an inter-module duct 22A from the preceding module, through a heat-rejecting heat exchanger 46, through a regenerator matrix 34, through a heat-accepting heat exchanger 47, and into an expansion space 54. The piston shell 32 and piston body 30 reciprocate as one piece. The upper surface of the piston shell provides the volume variation in the expansion space. The motion of the lower surface of the piston body provides the volume variation for the compression space 40 associated with the next module, forcing fluid through the inter-module duct 22B into the next module at a different pressure and velocity than in the preceding duct 22A because of the piston-to-piston phase change between adjacent modules. Compared to the prior art of FIG. 1 and FIG. 2 a fundamental simplification is that there is just one cylindrical sealing element per piston, which is made possible by incorporating the load or motoring device 23 within the working space instead of within a separate buffer space. A buffer space is generally defined as a space of substantially different pressure or fluid composition from the working space, although In a typical buffer space it is often only the pressure amplitude that is different, due to it having a smaller cyclic volume change per unit volume than the working space. There is often a slow leak between the working space and buffer space so that fluid composition is the same and mean pressure nearly the same.

Figure 5:
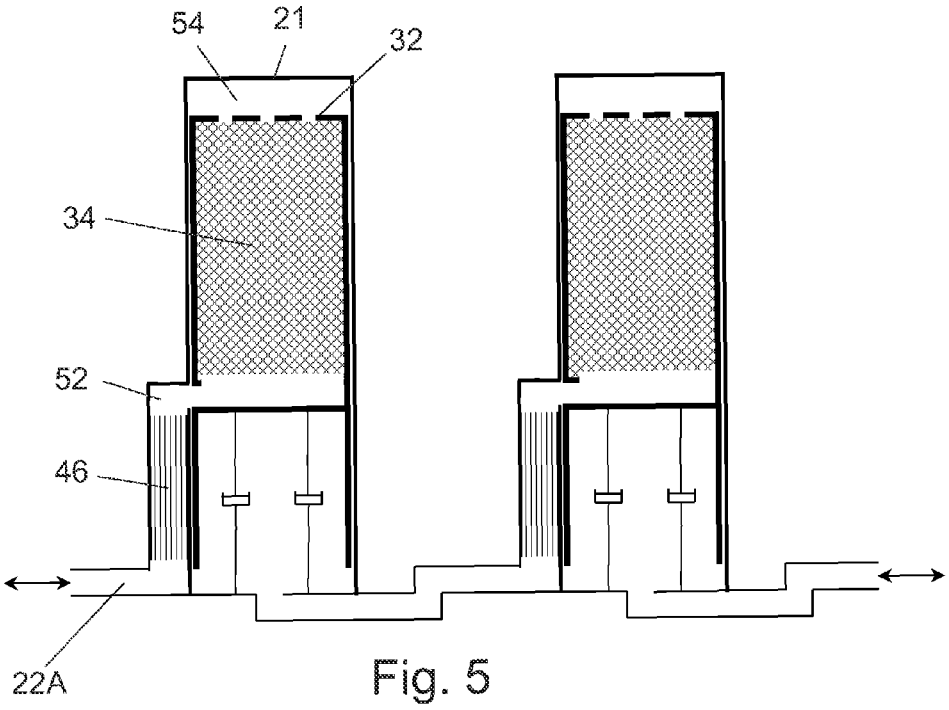
FIG. 5 shows a schematic of an embodiment that locates the regenerator matrix within the piston assembly.

Operation—Moving Regenerator Embodiment—FIG. 5

Figure 3:
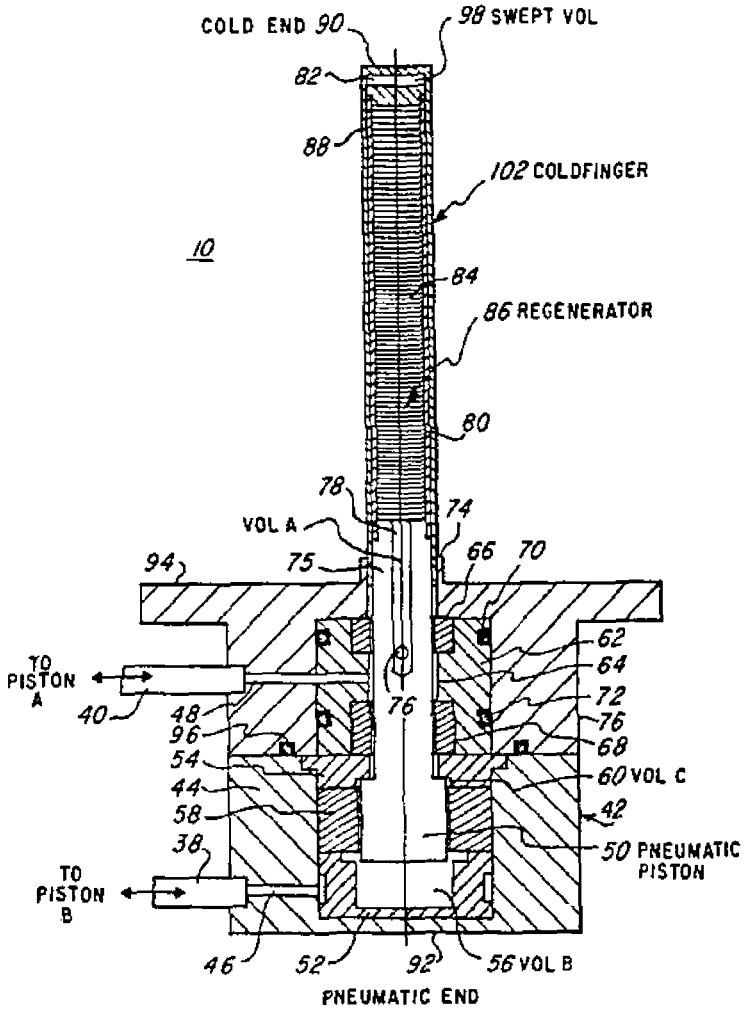
Fig. 3 Prior Art
FIG. 3 shows a prior art drawing of a split-cycle stirling cooler cold-finger with regenerator matrix within the displacer.

FIG. 5 shows another embodiment that differs from FIG. 4 by incorporating the regenerator matrix 34 into the piston shell 32 similar to the gamma-machine prior art of FIG. 3 except for the first time in a double-acting configuration. Starting at the left, fluid flows through the inter-module duct 22A from the preceding module, through a heat-rejecting heat exchanger 46, into a plenum 52, through a regenerator matrix 34 contained within a moving piston shell 32, and into an expansion space 54. Direct heat transfer between the fluid in the expansion space and a heat-acceptor plate 21 provides the functional equivalent of the heat-accepting heat exchanger. This embodiment is essentially equivalent to the embodiment of FIG. 4 from stirling-cycle thermodynamic point of view.

DETAILED DESCRIPTION—FIGS. 6-9

Figure 6:
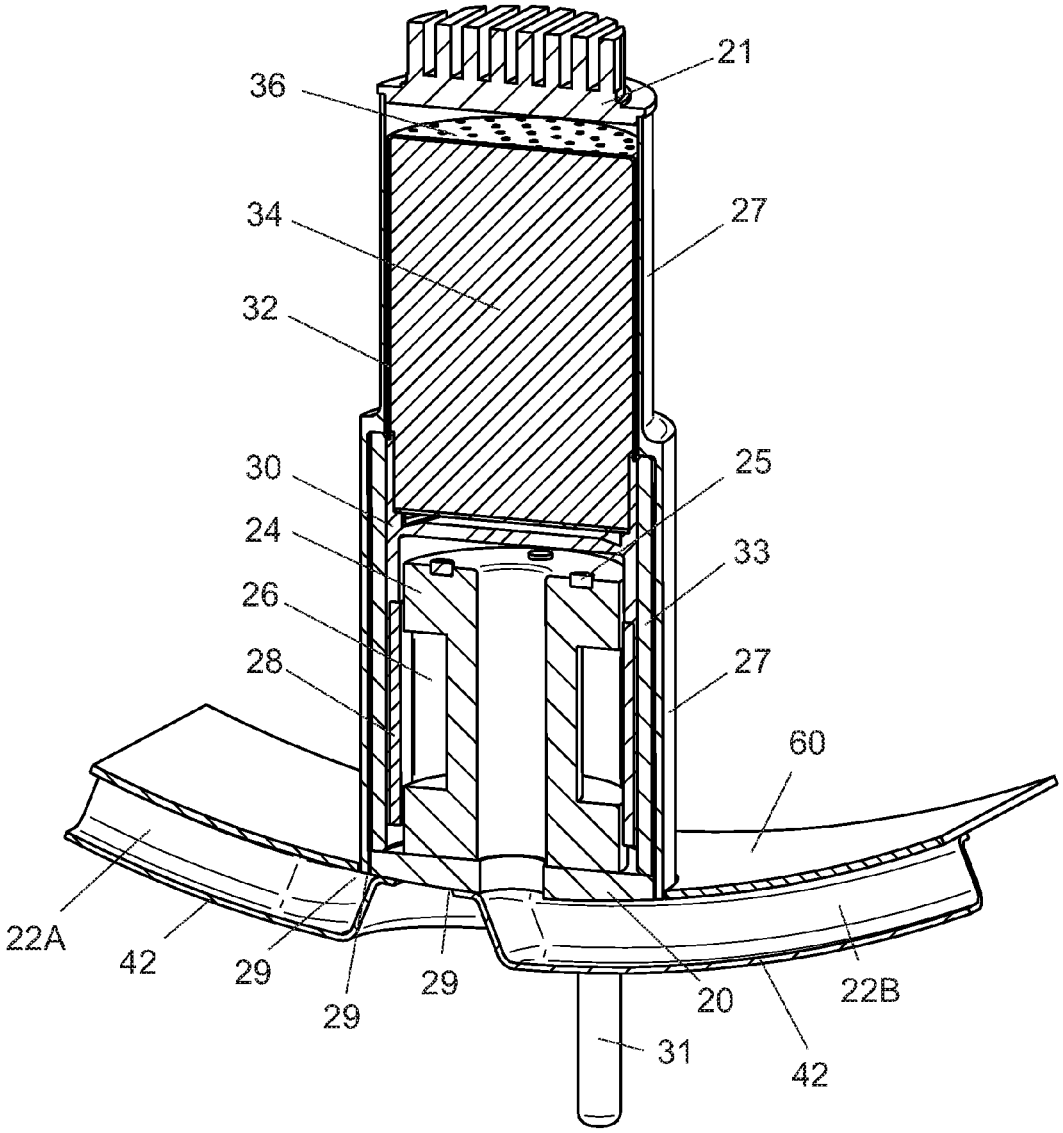
FIG. 6 shows a cross sectional view of components within a typical modular element of one physical embodiment.

Beginning with FIG. 6 the drawings correspond to more realistic machine views of one embodiment of FIG. 5 including additional components. The cross-sectional view of FIG. 6 shows:

(a) inter-module ducts 22A and 22B, and duct manifolds 42,
(b) a thermally conductive heat-rejection path 31 to the external ambient environment,
(c) a piston body 30,
(d) a piston shell 32 containing a regenerator matrix 34,
(e) a turbulator 36 consisting of a number of fluid passages at the end of the regenerator matrix,
(f) a pressure wall 27 joined to a thermally conductive heat-acceptor plate 21 at one end and at the other end to a duct plate 60 that forms a bounding surface for the inter-module ducts,
(g) an outer cylinder 33 of magnetically-soft ferromagnetic material that serves as a magnetic flux path and running surface for the piston body,
(h) an inner bobbin 24 of magnetically-soft ferromagnetic material that completes the magnetic flux path, anchored to a bobbin plate 20 at one end, with elastic bumpers 25 protruding from the other end to cushion the piston in the event of transient impacts,
(i) an electrical coil winding space 26 containing multiple turns of wire wound circumferentially,
(j) a permanent magnet ring 28 bonded to the piston body, and
(k) a number of sealing welds 29.

Piston Assembly—FIG. 7

FIG. 7 shows the components of the reciprocating piston assembly in an exploded cross sectional view. The piston assembly comprises the piston body 30, magnet ring 28, regenerator matrix 34, piston shell 32 and turbulator 36. The piston shell and turbulator may be formed of one continuous piece of material. The piston body includes an impermeable cross section and two cavities on opposite sides of that cross section. The regenerator matrix fits into an upper regenerator cavity and the magnet ring fits into a lower transducer cavity. The piston body includes ports 50 allowing the working fluid to enter the regenerator matrix. To make the piston assembly the magnet ring 28 may be adhesive bonded into the lower inside surface of piston body 30, the regenerator matrix 34 inserted into the piston shell 32, and the piston shell then adhesive bonded to the upper part of the piston body.

Module Assembly—FIG. 8

FIG. 8 shows subassemblies of a final module in an exploded cross sectional view. At the top is the subassembly consisting of the heat-acceptor plate 21 joined to the pressure wall 27. In a heat engine application the upper end temperature may be red hot so the pressure wall should be made of a high strength high temperature material with relatively low conductivity such as stainless steel in order permit a thin wall that reduces thermal conduction loss. The heat-acceptor plate should be made of a high temperature high conductivity material such as nickel to facilitate heat transfer to the expansion space (54 of FIG. 9). Material strength is not critical in the acceptor plate because it can be relatively thick. In a cooler or heat pump application the pressure wall material need not withstand high temperature so it may be made of a high strength low conductivity material such as titanium. The acceptor plate may be a low-temperature conductive material such as copper.

Below the pressure wall in FIG. 8 is the reciprocating piston assembly with all components in their final positions so only the piston shell 32 and piston body 30 are visible.

Below the piston assembly are the outer cylinder 33, the inner bobbin 24 with wire feed through tubes 68, bobbin plate 20, finned heat-rejecting heat exchangers 46 and thermally conductive heat-rejection paths 31. The wire coil (not shown) consists of a number of turns wound around the bobbin with the terminal wire segments passing through hermetically sealed wire feed through tubes 68 to the external environment. The bobbin may be adhesive bonded or otherwise joined to the bobbin plate, anchoring the bobbin and also isolating the working fluids in the two thermodynamic circuits from each other and from the external atmosphere where the wire feed through tubes 68 pass through the bobbin plate.

The reciprocating piston assembly is enclosed within a housing, narrowly defined as the components immediately outside its operating envelope, comprising in this embodiment the outer cylinder 33, the upper part of the pressure wall 27 (outside the piston shell 32), the heat-acceptor plate 21 at one end, and the bobbin plate 20 at the other end.

The subassemblies of FIG. 8 are shown in their final positions in FIG. 6. The assembled module is hermetically sealed by welds 29, or other means joining and sealing:

(a) bobbin plate 20 to the inside edge of pressure wall 27,
(b) duct plate 60 to the outside edge of pressure wall 27,
(c) duct manifolds 42 to the outer surface formed by the duct plate, bobbin plate and pressure wall end, forming inter-module ducts 22, and
(d) duct manifold 42 to flanges (not shown) around the thermally conductive heat-rejection paths 31.

Fluid Circuit—FIG. 9

The cross-sectional view of FIG. 9 shows a cutaway view of a working-fluid thermodynamic circuit located between piston body 30A on the left and 30B on the right. It is topologically equivalent to the circuit illustrated schematically in FIG. 5. The following account applies to a time in the cycle when piston body 30A is moving down and piston body 30B is substantially stationary. The lower surface of piston body 30A displaces volume in compression space 40, forcing working fluid through the hole in the inner bobbin 24, which is the initial part of the inter-module duct 22. In this embodiment the inter-module duct is formed by a stamped duct manifold 42 welded or otherwise joined to the duct plate 60, which has been removed from FIG. 9 for clarity (see instead FIG. 6). The inter-module duct splits into two symmetrical channels at the right end, directing the working fluid through finned heat-rejecting heat exchangers 46 where it give up heat to thermally conductive heat-rejection paths 31 connected at the bottom to an external ambient sink (not shown). The working fluid continues through cylinder ports 48 and piston ports 50, radially into a flow distribution plenum 52, where it then turns axially upward through the regenerator matrix 34, finally through the turbulator 36 into an expansion space 54. Clearer views of the heat-rejecting heat exchangers, cylinder ports, piston ports and turbulator are shown in the exploded views of FIG. 7 and FIG. 8.

Electromechanical Transducer

The load or motoring device within the embodiment illustrated in FIGS. 7-8 is an electromechanical transducer in the form of a moving-magnet type linear motor (or generator in the case of an engine), located substantially within the lower cavity of the piston body 30, referred to in the claims as the transducer cavity. The magnet ring 28 is radially-polarized and bonded to the inner wall of the moving piston body 30, which is made from a material of low electrical conductivity to reduce eddy current losses. The inner bobbin 24 and outer cylinder 33 are made of magnetically-soft ferromagnetic material and form a magnetic flux path with the flux direction alternating, depending on the magnet position. A alternating electrical current applied to the terminal ends of a coil wound around the inner bobbin 24 creates a magnetic field that interacts with the magnetic field of the permanent magnet ring, producing a force that drives the magnet ring and attached piston body back and forth in the axial direction. The moving piston body wall 30 forms a clearance seal (close-fit radial gap) with the outer cylinder 33 so the two should have similar rates of thermal expansion.

The outer surface of the coil wound within the bobbin space 26 is in direct contact with the working fluid and subject to the full stirling-cycle pressure variation so it should be impermeable to that working fluid to avoid thermodynamic losses associated with fluid flowing through the interstitial spaces between wires. This may be accomplished by filling the interstitial spaces with a solid potting compound.

In all components subject to fluctuating magnetic flux, either low electrical conductivity, a laminated structure or an electrically insulating composite ferromagnetic material can be used to reduce eddy current losses. In the case of the permanent magnets, which are generally electrically conductive, eddy currents can be reduced by fabricating the magnet ring from a plurality of axial segments, similar to laminations. For the inner bobbin and outer cylinder, laminations would be difficult to fabricate so they may instead be made from iron powder composite or a similar material. That same material could be used for the moving piston which would prevent any differential thermal expansion issues while also reducing the magnetic reluctance across the radial air gap. However to reduce weight and reduce the surface friction coefficient, an alternative piston body material is a lightweight, low-friction, non-magnetic, electrically insulating material of similar thermal expansion coefficient to the outer cylinder.

In the above embodiment the inner bobbin 24 and outer cylinder 33 are both stationary structures attached to the bobbin plate 20 with the permanent-magnet ring moving in the gap between the two. That arrangement produces low magnet side forces because a displacement of the magnet ring in the radial direction does not change the total air gap between the inner bobbin and outer cylinder.

Locating the electromechanical transducer inside a cavity within the piston body is an innovation relative to prior art achieved through an integrated design process where the stirling machine and electromechanical transducer are designed together, rather than separately. In the embodiment illustrated this was accomplished by an automated optimization process that simultaneously adjusted a number of operating parameters such as operating frequency, working fluid charge pressure, power output level, and various machine dimensions so that the transducer power matched the stirling machine power within the dimensional constraints imposed by fitting the electromechanical transducer inside the piston.

Turbulator Flow Area Reduction

In FIG. 9 there is no heat-accepting heat exchanger in the usual sense of a flow channel. Instead the turbulator 36 at the end of the regenerator includes a number of passages that reduce the fluid flow area relative to the regenerator matrix in order to direct relatively high velocity fluid jets into the expansion space 54 where they augment heat transfer directly from the internal face of the heat-acceptor plate 21 by means of high turbulence levels or jet-impingement heat transfer.

Paths of High Thermal Conductivity

In FIG. 9 the heat-acceptor plate 21 serves as a path of high thermal conductivity carrying heat from the external heat source on the outside (not shown) to the expansion space 54 on the inside. Additional paths of high thermal conductivity 31 carry heat from the heat-rejecting heat exchangers 46 to an external heat sink (not shown). These heat-rejection paths of high thermal conductivity are illustrated as cylinders that might take the form of high-conductivity solid materials or tubes containing two-phase heat transport fluids—e.g. heat pipes or thermosiphons. Compared to a solid conductive material like copper, a heat pipe or thermosiphon can simultaneously increase thermal conductance (increasing thermodynamic efficiency), reduce weight and reduce material cost.

Clearance Seals

In the embodiment shown in FIGS. 6-9, the piston bodies 30 run within close-fit outer cylinders 33 so that the radial gap between the two functions as a clearance seal. There are actually two parts of these clearance seals, one above the aligned ports 48 and 50 and one below. Referring to piston body 30A in FIG. 9 the lower part 62A seals the fluid circuit described above from the adjacent fluid circuit. Referring to piston body 30B the upper part 62B prevents regenerator blow-by within the fluid circuit described above.

Free Piston Operation

As with any free piston machine there are spring forces acting on the piston assemblies in order to resonate them at the desired operating frequency. In the illustrated embodiment these spring forces are supplied primarily by the working fluid pressures acting on the upper and lower surfaces of the piston bodies through the action of the two working fluid circuits bounding those surfaces. The fluid circuits behave to some extent like gas springs. There are no mechanical springs.

Accomplishing free-piston operation imposes another constraint on the freedom to independently choose operating frequency, fluid charge pressure, piston body diameter, piston assembly mass, and so forth. In the embodiment illustrated this constrained was satisfied as part of the automated optimization process.

Magnetic Centering

The electromechanical transducer as above described has self-centering properties. With zero electrical current in the coil and the magnet centered between the poles there is no net axial magnetic force on the magnet (force between stationary poles and moving magnet) because of symmetry. But there is magnetic flux through the air gap between poles beyond the magnet endpoints because of the magnetic potential across the poles produced by the magnet. When the magnet moves off center the magnetic potential across the gap is less because there is now magnetic flux directed axially in the inner bobbin and axially but oppositely in the outer cylinder and some magnetic potential is needed to overcome the magnetic reluctance. This results in reduced magnetic flux across the uncovered air gap and an increase in field potential energy. So there is a force tending to pull the magnet back to the minimal-energy center position. This intrinsic centering force can be increased by increasing the reluctance of the ferromagnetic paths. In prior art (Redlich U.S. Pat. No. 6,483,207) centering force was achieved by magnetically saturating the ferromagnetic material producing a significant restoring force only near the extreme limits of the magnet position. In the present improvement the reluctance is increased by other means, such as by fabricating the ferromagnetic path from composite powdered iron material, which has intrinsically lower magnetic permeability than conventional solid ferromagnetic materials. By controlling reluctance this way there is no need to saturate the material to produce magnetic centering and the magnetic restoring force varies approximately linearly as a function of piston displacement from its center position, like a simple spring.

The lower permeability of powdered iron composite results in part from the cumulative effects of tiny air gaps in the interstitial spaces between ferromagnetic particles. Introducing a controlled air gap near the mid-plane of the inner bobbin or outer cylinder offers an additional means to further increase the magnetic reluctance of the flux path and increase the magnetic centering force.

The symmetry of the double acting configuration reduces the tendency for the piston assembly to drift off center during operation. This is often a significant issue in beta type free piston machines where the piston tends to drift one way or the other due to a preferred leak direction (lower flow resistance in one direction than the other) or asymmetric pressure variation on the two ends of the piston. In the double-acting alpha configuration there may be a preferred leak direction in any given piston body seal due to asymmetries in the seal length versus seal pressure difference or pressure difference versus time. But to the extent all piston seals and fluid circuits are identical, any net flow through one piston seal is canceled by the net flow through the next. So the net working-fluid leak from one circuit to the next is mainly due to manufacturing tolerance differences between adjacent piston seals. The magnetic centering forces are designed so that they provide sufficient mean force bias to counteract any tendency for piston drift with acceptably small mean position displacement from the nominal value.

Seal Wear

To achieve long operating life requires some means to prevent wear between the piston and its outer cylinder in the region of the close-fit clearance seal. Because there are low side forces acting on the piston, one means to reduce wear to an acceptable level is by simply using low-friction materials or coatings for the piston or outer cylinder, with one or both surfaces polished to a smooth finish.

Wear can be further reduced by providing a number of circumferential flow channels around the piston or cylinder wear surfaces so that the flow resistance in the circumferential direction is reduced without much affecting the axial flow resistance. This technique is established prior art in the field of hydraulic technology and reduces seal wear because it reduces circumferential pressure variations in the piston seal that add to the piston side load. Circumferential pressure variations arise when the clearance seal is not perfectly uniform and the axial pressure distributions on opposite sides of the piston are different.

In some embodiments contact between the piston and outer cylinder can be substantially eliminated by use of fluid bearings or by accurate radial alignment of the piston assembly within its cylindrical housing via some sort of mechanical spring structure attached at each end of the piston—flexible in the axial direction but stiff in the radial direction. One type of fluid bearing system is based on the principle of admitting a controlled inward radial fluid flow, from a reservoir maintained near the peak working-space pressure, through the outer cylinder into the clearance seal and exiting toward either end of the seal. Radial flow through the outer cylinder can be achieved through separate flow restriction channels or distributed uniformly by controlling the porosity of the cylinder material. The radial pressure drop though the outer cylinder is adjusted so that when the clearance seal gap is large the main flow resistance is through the outer cylinder so the piston face sees a pressure in the clearance seal near the current working-space pressure. When the clearance seal gap is small the main flow resistance is along the clearance seal so the piston face sees something like the peak working-space pressure of the reservoir. So except near the time of peak cycle pressure there is a radial restoring force to equalize the gaps on diametrically opposed sides of the piston body. The fluid supply reservoir may be maintained at a pressure near the peak working-space pressure by admitting flow from the working space through a check valve.

Radial Arrangement—FIGS. 10, 11

FIG. 10 shows an embodiment comprising eight modules in a radial ring arrangement. This embodiment directs the external heat-accepting and heat-rejecting interfaces along inward-facing and outward facing cylinders. The heat source (not shown) is centrally located where it is easily insulated from the ambient temperature surroundings and compatible with many heat source geometries. The heat-accepting surface area is relatively small consistent with the high heat-transfer coefficients typically available in heat sources. The heat-rejection surface is located on the outside, where the ambient environment is usually found. Its surface area is relatively large consistent with the relatively low heat transfer coefficients of the ambient environment. FIG. 11 shows a stack of such rings that might be used to produce a machine of higher power level.

Vacuum Insulation Space

In the radial arrangement illustrated in FIG. 10 the cylindrical duct plate 60 forms the outer wall of a vacuum insulation space, at ambient temperature. The cylindrical inner wall 70 forms the inner wall of that vacuum space, at a lower temperature (or higher in the case of a heat engine). The purpose of the vacuum space is to prevent thermal loss by convective heat transfer between the outer wall and inner wall. The inner vacuum wall is designed with flattened regions 71 that are slightly flexible to accommodate the strain induced by contraction of the pressure walls 27 during cool-down (or heat-up in the case of a heat engine) without damage.

Vibration Cancelling

FIG. 10 shows a ring with 8 modular elements but it can have any multiple of 3, 4, 5 or 6 elements providing relative piston phasing of 120, 90, 72 or 60 degrees respectively. The relative piston phasing establishes the phasing between the compression and expansion spaces for the thermodynamic cycle. A relative phasing of 90 degrees was chosen for the illustrated embodiments but the other phase angles are possible.

Dynamic balance may be achieved by running radially opposed piston pairs 180 degrees out of phase in an absolute reference frame, or in phase relative to the modular element reference frame. That means the complete ring should comprise even multiples of 3, 4, 5, or 6 modular elements (e.g. 6, 8, 10, 12, 16, 20, . . . ) to achieve dynamic balance.

Parallel Arrangement and Vibration Cancelling—FIG. 12

FIG. 12 shows an embodiment comprising 4 modules in a co-axial cylindrical arrangement. In this arrangement the module axes are parallel but offset from one another and equal-spaced around a cylinder. Straight forward vector (phasor) addition shows that this parallel arrangement is dynamically balanced along the axis of piston motion so long as all piston masses and amplitudes are equal and phases uniformly distributed. (The acceleration force phasors look like equal-spaced radial spokes in a wheel and by symmetry sum to zero.) However there are generally nutation forces that produce torques normal to the module axis, except in certain cases such as when diametrically opposite piston pairs move in phase so that their resultant motion is equivalent to a single piston of twice the mass moving along the central axis. That occurs for the same number of modules per ring as the above radial arrangement.

Staged Embodiments for Cryocoolers—FIGS. 13, 14

As in prior art, to achieve lower temperatures when operating as a cooler it is possible to stage either the radial or co-axial embodiments by using a stepped piston, as illustrated for the case of two stages in FIG. 13. The piston shell now contains two regenerator matrices, a first-stage matrix 34A and second-stage matrix 34B. The piston step effectively forms an intermediate first-stage expansion space 54A, with a second-stage expansion space 54B at the far end of the piston. The first-stage regenerator cools the first stage expansion space to some intermediate cold temperature. The second-stage regenerator cools the second-stage expansion space to a temperature below the intermediate cold temperature and rejects heat to the intermediate expansion space. The stepped part of the pressure wall in the region of the intermediate expansion space could be made from a high conductivity material like the heat-accepting plate 21 for thermal connection to a cooling load, like a radiation shield, or just float in temperature, unconnected to a cooling load. In principle there can be an additional piston step to form a second intermediate expansion space, creating a three-stage cooler, and so forth. FIG. 14 shows an embodiment comprising eight two-stage modules in a radial ring arrangement.

CONCLUSION, RAMIFICATIONS AND SCOPE OF INVENTION

These embodiments of double-acting, modular, balanced, free piston stirling machines are compact, scalable, and capable of interfacing with a wide range of heat sources and heat sinks in various stirling heat pump and stirling engine applications. Each module contains relatively few, simple parts, amenable to low-cost high-volume manufacturing methods. A single module size can be adapted to a wide range of application power levels by combining more or fewer modules together to achieve the desired power level.

The description above pertains to particular embodiments of the invention and should not be construed as limitations on the scope of the invention. Accordingly, the scope of the invention should be determined by the appended claims and their legal equivalents.

I claim:

1. A free-piston double-acting Stirling-cycle machine comprising a plurality of interconnected modules, each module comprising:

a. a cylindrical piston assembly moving back and forth axially within a cylindrical side wall of an enclosing housing, providing both compression and expansion within a Stirling-cycle working space, b. an electromechanical transducer operatively connected to said piston assembly and disposed within the Stirling-cycle working space, and c. said piston assembly comprising a piston body and a piston shell, where said piston body includes a transducer cavity at one end configured to enclose one or more elements of said electromechanical transducer.

2. The Stirling-cycle machine of claim 1 further including:

a. said piston body including a regenerator cavity at the end opposite said transducer cavity, separated from said transducer cavity by a thin impermeable cross section, b. the walls of said piston body and said side wall of said housing both including axially aligned ports configured to allow working fluid to flow between a region outside of said housing and said regenerator cavity, c. a porous regenerator matrix enclosed within said piston assembly and bounded by said regenerator cavity and an end of said piston shell, through which working fluid flows in the axial direction turning radially through said ports, d. the outside of said piston body and inside of said side wall of said housing forming a close-fit radial clearance seal, and e. said plurality of interconnected modules interconnected using inter-module ducts to form a plurality of Stirling-cycle thermodynamic fluid circuits, each circuit comprising a compression space defined by the boundary of the transducer-cavity end of said piston body in one module moving within its housing, a heat-rejecting heat exchanger between said compression space and said ports within an adjacent module, said regenerator matrix within said piston assembly of said adjacent module, a heat-accepting heat exchanger, and an expansion space defined by the end of said piston shell moving within said housing.

3. The Stirling-cycle machine of claim 2 further including a predetermined flow-area reduction in the flow passages through the end wall of said piston shell between said regenerator matrix and said expansion space, serving to direct a plurality of fluid jets into said expansion space, providing a means to augment heat transfer directly between the surface of said expansion space and the working fluid within, thereby providing the functionality of said heat-accepting heat exchanger.

4. The Stirling-cycle machine of claim 2 further including a heat-rejection path of high thermal conductivity, whereby heat rejected from said heat-rejecting heat exchanger is directed to an external heat sink.

5. The Stirling-cycle machine of claim 1 wherein said electromechanical transducer comprises an electrical coil carrying electrical current wound around the outside of an inner bobbin, comprising a spool-shaped cylindrical core of soft ferromagnetic material, said bobbin affixed at one end to an end wall of said housing, a radially polarized permanent magnet affixed to the inner wall of said transducer cavity within said piston body such that magnetic flux is directed in alternating axial directions through the central core of said bobbin as said piston body moves axially back and forth, and an outer cylinder magnetic flux return path of soft ferromagnetic material also serving as said side wall of said housing.

6. The Stirling-cycle machine of claim 5 further including a predetermined magnetic reluctance of said soft ferromagnetic materials, providing a means to create a magnetic restoring force that varies directly with the axial displacement of said piston body from its center position, thereby providing the functionality of a spring.

7. The Stirling-cycle machine of claim 1 wherein said plurality of interconnected modules are connected in a radial ring arrangement with the modular axes lying along radial rays sharing a common intersection at a center point, such that heat-accepting and heat-rejecting surfaces thereof are directed along inward-facing and outward-facing cylinders, whereby heat transfer connections to and from an external heat source and heat sink are simplified.

8. The Stirling-cycle machine of claim 7 wherein said piston assemblies are arranged in radially-opposed pairs and where the inter-module phasing of said piston assemblies and number of said modules in said radial ring arrangement is configured to maintain a stationary center of gravity of said radially-opposed pairs, and configured to reduce the net vibration forces produced by said Stirling-cycle machine on its surroundings.

9. The Stirling-cycle machine of claim 7 wherein said modules are anchored at the heat-rejection end to a cylindrical outer wall, co-axial with said radial ring arrangement, and joined at the heat-accepting end to a cylindrical inner wall, incorporating flexible regions providing a means to accommodate the movement of said modules induced by thermal contraction or expansion.

10. The Stirling-cycle machine of claim 1 wherein said modules are connected in a parallel-axis arrangement with the modular axes parallel and equal spaced around a cylinder, such that heat-accepting and heat-rejecting surfaces thereof form planes, whereby heat transfer connections to and from an external heat source and heat sink are simplified.

11. The Stirling-cycle machine of claim 10 wherein said moving piston assemblies are arranged in diametrically-opposed pairs and where the inter-module piston assembly phasing and number of said modules in said parallel-axis arrangement is configured such that the phasing of said diametrically-opposed pairs is identical, whereby the net vibration forces produced by said Stirling-cycle machine on its surroundings is reduced.

12. An electromechanical transducer for converting electrical current to mechanical force or mechanical motion to electrical voltage, comprising:

(a) an electrical coil carrying electrical current wound around the outside of an inner bobbin, comprising a spool-shaped cylindrical core of soft ferromagnetic material, (b) a radially polarized permanent magnet located radially outside said bobbin and affixed to the inner wall of an axially moving piston body such that magnetic flux is directed in alternating axial directions through the central core of said bobbin as said piston body moves axially back and forth, (c) an outer cylinder of soft ferromagnetic material located immediately outside the outer wall of said axially moving piston body, serving as a magnetic flux return path and also serving to guide said piston body, and (d) mechanical forces applied between said bobbin and said piston body and electrical connections made to the end terminals of said electrical coil.

13. The electromechanical transducer of claim 12 further including a predetermined magnetic reluctance of said soft ferromagnetic materials, providing a means to create a magnetic restoring force that varies directly with the axial displacement of said piston body from its center position, thereby providing the functionality of a spring.

* * * * *